United States Patent [19]

Schülein et al.

[11] 4,390,109

[45] Jun. 28, 1983

[54] KEEP-FRESH STORAGE CONTAINER WITH LID

[75] Inventors: Rolf-Günter Schülein, Singhofen; Leonard Hagedorn, Niederneisen, both of Fed. Rep. of Germany

[73] Assignee: ITT Industries, Inc., New York, N.Y.

[21] Appl. No.: 359,716

[22] PCT Filed: Jun. 24, 1981

[86] PCT No.: PCT/DE81/00096

§ 371 Date: Mar. 3, 1982

§ 102(e) Date: Mar. 3, 1982

[87] PCT Pub. No.: WO82/00126

PCT Pub. Date: Jan. 21, 1982

[30] Foreign Application Priority Data

Jul. 3, 1980 [DE] Fed. Rep. of Germany ..... 3025200

[51] Int. Cl.[3] ..... B65D 53/00

[52] U.S. Cl. ..... 220/234

[58] Field of Search ..... 220/233, 234, 237; 215/359; 222/484

[56] References Cited

U.S. PATENT DOCUMENTS 3,756,480 9/1973 Swett et al. ..... 220/234

4,895,578 10/1981 Parent ..... 220/234

*Primary Examiner*—George T. Hall

*Attorney, Agent, or Firm*—John T. O'Halloran; Peter R. Ruzek

[57] ABSTRACT

Keep-fresh storage container having a two-part lid consisting of a stiff part with handle webs and rim and of a deformable sealing part fastened thereto.

10 Claims, 2 Drawing Figures

KEEP-FRESH STORAGE CONTAINER WITH LID

Figure 1:
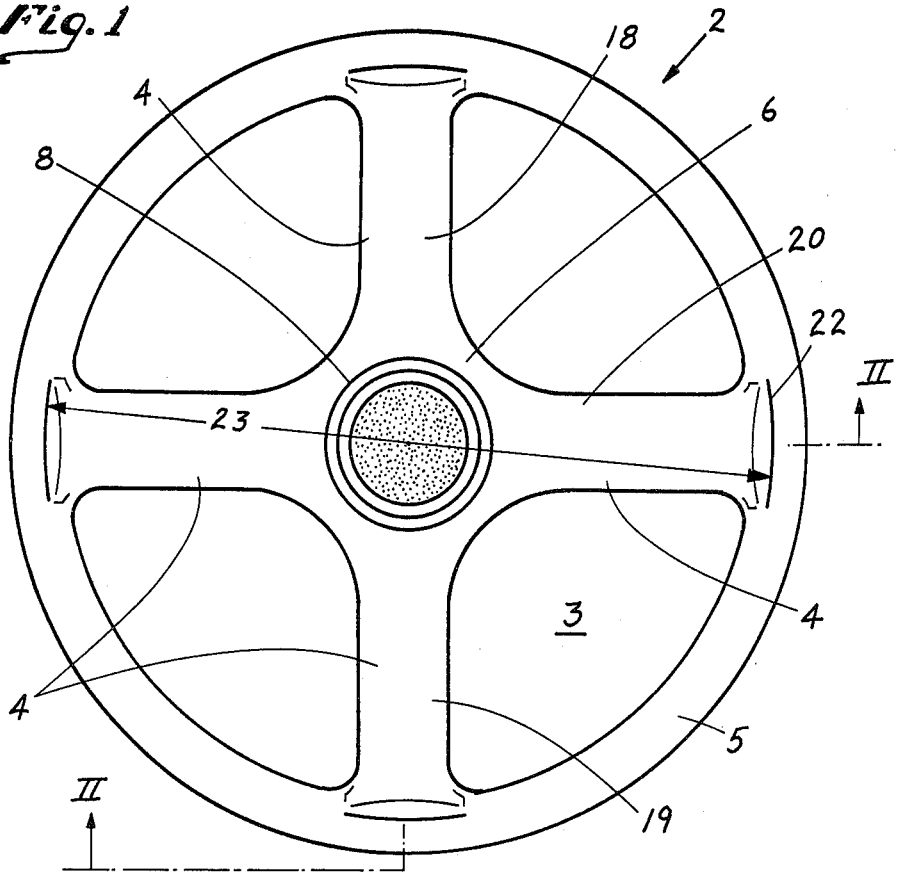

The invention relates to a keep-fresh storage container with lid according to the preamble of claim 1.

Keep-fresh storage containers make it possible to store foods under substantially airtight conditions in the kitchen. The foods are thereby prevented from drying out.

A keep-fresh storage container with lid according to the preamble of patent claim 1 is known (German Pat. No. 1779293), in which closed and open positions are obtained through the elastic deformation of the lid. The closing and opening operations are effected by reversing the curvature of the lid. This means that a relatively large amount of space is required for the lid, so that the storage capacity available is reduced accordingly. Handling is complicated because in order to open the lid the container must be held in the opposite direction. Another disadvantage is to be seen in the fact that the material of the lid must be as soft as possible if easy handling is to be achieved, whereas the material should be as stiff as possible in order to ensure reliable closure. With a lid design of this type of keep-fresh storage containers cannot be stacked for storage.

The invention seeks to provide a remedy in this respect. The problem underlying the invention is that of providing a keep-fresh storage container whose lid can be easily opened in an obvious manner by one hand, closes tightly, and in addition permits stacking of the individual keep-fresh storage containers.

This problem is solved by the characterising features of claim 1. Due to the separation of the handle and its rim from the actual lid, materials of different stiffnesses can be chosen. This makes it possible for the handle webs and the rim to be made very stiff, while the lid part can be designed solely from the point of view of optimum sealing. The deflection of the lid part during the opening operation is slight, so that little storage capacity is lost.

Other advantageous features of the invention can be seen in the sub-claims. Thus, the special construction of the rim has the advantage that on the one hand it provides additional stiffness and on the other hand it ensures simple, reliable fastening of the lid part. This can be achieved by adhesive bonding or, as particularly stated, by means of the holding ring. This has the additional advantage that the two components can be separated for cleaning purposes.

Through the construction of the handle webs with a guide tube for the operating member, particularly easy handling can be achieved. There can be no uncertainty about how this container is to be opened.

Stackability, which is already provided by the flat shape of the handle webs, is further improved by the axially extending shoulders and the bottom shoulder on the container. The stacked keep-fresh containers are prevented from slipping off accidentally.

Another advantage is achieved through the filling-level shoulder. This serves not only to prevent overfilling of the keep-fresh storage container but also to facilitate its handling. A keep-fresh storage container which is for example wet is thus prevented from slipping out of the hand.

One example of embodiment of the invention is explained more fully below with reference to the drawings, in which:

FIG. 1 is a plan view of a keep-fresh storage container, and

Figure 2:
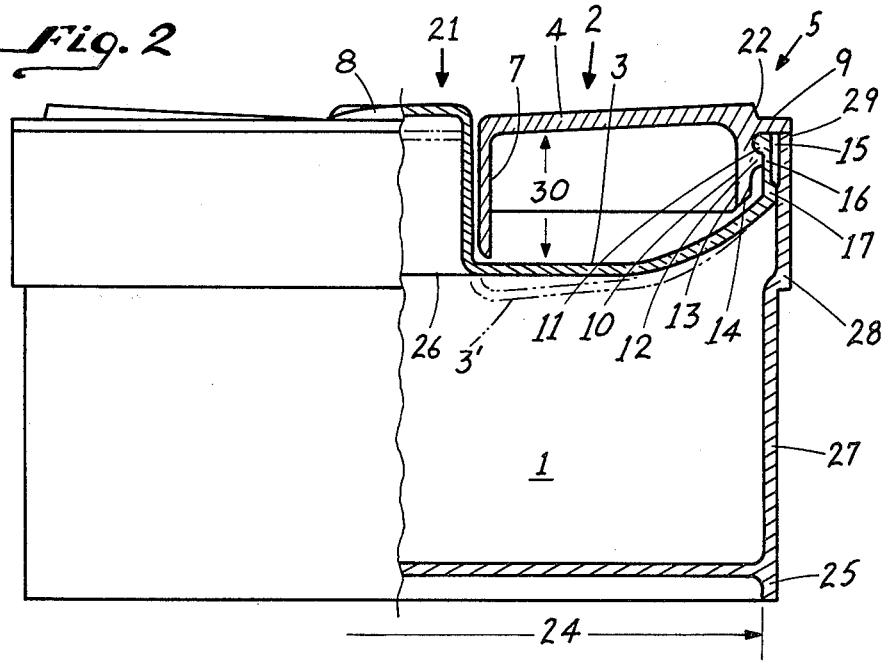

FIG. 2 an elevation partly in section on the line II—II in FIG. 1.

A keep-fresh storage container 1 is closed by a lid 2. The lid 2 is made in two parts and consists essentially of a curved, deformable lid part 3 and the handle webs 4, which merge into a rim 5. The handle webs 4 converge in a control region 6 to form a guide tube 7. This guide tube 7 has passing through it an operating member 8 moulded integrally to the lid part 3.

The rim consists of a disc-shaped seating region 9 and a tubular fastening region 10. The latter has a holding groove 11 bounded by the seating region 9 and a holding ring 12, and merges into a radially tapered region 13. This region 13 is provided with a bevel 14.

A bead 15 on the lid part 3 engages in the holding groove 11. The bead 15 first continues as a lid ring 16 merging into a projection 17 directed radially outwards, and then continues as a slightly curved part extending to the operating member 8.

FIG. 2 shows the tightly closed position of the keep-fresh storage container. In order to remove the lid, the index finger is placed under the handle web 18 and the middle finger under the handle web 19, thus enclosing the handle web 20 between these two fingers, while pressure is applied by the thumb to the operating member 8 in the direction of the arrow 21. The lid part 3 is thereby brought into the open position 3' shown in broken lines, whereby the projection 17 is pulled radially inwards.

At the points where the handle webs 4 merge into the rim 5, axially extending shoulders 22 are provided. The diameter 23 of these shoulders is equal to or smaller than the inside diameter 24 of a container bottom shoulder 25.

At the height of the lower edge 26 of the lid part 3 the container 27 is provided with a filling-level shoulder 28, which extends as far as the container edge 29.

The access depth between the handle webs 4 and the lid part 3 is designated 30.

List of reference numerals

1. Keep-fresh storage container
2. Lid
3. Lid part
3'. Lid part in open position
4. Handle webs
5. Rim
6. Central region
7. Guide tube
8. Operating member
9. Seating region
10. Fastening region
11. Holding groove
12. Holding ring
13. Radially tapered region
14. Bevel
15. Bead
16. Lid ring
17. Projection
18. Handle webs
19. Handle webs
20. Handle webs
21. Direction of arrow
22. Shoulder
23. Diameter
24. Inside diameter 25. Container bottom shoulder
26. Lower edge
27. Container
28. Filling-level shoulder
29. Container edge
30. Access depth

We claim:

1. Keep-fresh storage container comprising a container and a detachable, elastically deformable, curved lid, which is provided in the middle with a handle and is provided with a rim, and which by alteration of the curvature of the lid can be deformed in such a manner that it can lie either with clearance or with close contact against the edge of the container, characterised in that the handle is in the form of handle webs (4) which merge into the rim (5), while a curved, deformable lid part (3), which is provided approximately in the centre with an operating member (8), acts on the rim (5) lying on the container edge (29).

2. Keep-fresh storage container according to claim 1, characterised in that the rim (5) consists of a disc-shaped seating region (9) and a tubular fastening region (10) for the lid part (3).

3. Keep-fresh storage container according to claim 2, characterised in that the fastening region (10) has a holding ring (12), behind which the lid part (3) engages by means of a bead (15), and that the fastening region (10) below the holding ring (12) has a radially tapered construction.

4. Keep-fresh storage container according to one of claims 1 to 3, characterised in that the handle webs (4) converge centrally to form a guide tube (7) for the operating member (8).

5. Keep-fresh storage container according to claim 4, characterised in that the guide tube (7) is disposed at such a depth that on the one hand the operating member (8) extends as a maximum to the top edge of the handle webs (4) and that on the other hand an access depth (30) of at least finger cross-section dimension is provided between the lid part (3) and the handle webs (4).

6. Keep-fresh storage container according to claim 4 or 5, characterised in that the operating member (8) and the lid part (3) are made in one piece.

7. Keep-fresh storage container according to one of claims 1 to 6, characterised in that the handle webs (4) are each provided with an axially extending shoulder (22), while the diameter (23) of these shoulders (22) is equal to or smaller than the inside diameter (24) of a container bottom shoulder (25).

8. Keep-fresh storage container according to claim 7, characterised in that the shoulders (22) are provided at the points where the handle webs (4) merge into the rim (5).

9. Keep-fresh storage container according to one of claims 1 to 8, characterised in that the container (27) is provided with a filling-level shoulder (28).

10. Keep-fresh storage container according to claim 9, characterised in that the container is conically tapered underneath the filling-level shoulder.

* * * * *